US007957548B2

(12) United States Patent
Meier et al.

(10) Patent No.: US 7,957,548 B2
(45) Date of Patent: Jun. 7, 2011

(54) HEARING DEVICE WITH TRANSFER FUNCTION ADJUSTED ACCORDING TO PREDETERMINED ACOUSTIC ENVIRONMENTS

(75) Inventors: Hilmar Meier, Zurich (CH); Michael Boretzki, Rueti (CH); Hubert Lechner, Zurich (CH); Manuela Feilner, Herrliberg (CH); Silvia Allegro-Baumann, Unteraegeri (CH); Hans-Ueli Roeck, Hombrechtikon (CH); Andi Vonlanthen, Remetschwil (CH)

(73) Assignee: Phonak AG, Staefa (CH)

( * ) Notice: Subject to any disclaimer, the term of this patent is extended or adjusted under 35 U.S.C. 154(b) by 1253 days.

(21) Appl. No.: 11/470,639

(22) Filed: Sep. 7, 2006

(65) Prior Publication Data

US 2007/0269053 A1 Nov. 22, 2007

Related U.S. Application Data

(60) Provisional application No. 60/747,330, filed on May 16, 2006.

(51) Int. Cl.
*H04R 25/00* (2006.01)

(52) U.S. Cl. ..... 381/312; 381/314; 381/316; 381/317

(58) Field of Classification Search ..... 381/312, 381/316, 317

See application file for complete search history.

(56) References Cited

U.S. PATENT DOCUMENTS 5,604,812 A 2/1997 Meyer
6,236,731 B1 * 5/2001 Brennan et al. ..... 381/316
6,735,317 B2 5/2004 Paludan-Mueller
6,806,820 B1 * 10/2004 Dhalla et al. ..... 341/144
6,910,013 B2 6/2005 Allegro et al.
7,433,481 B2 * 10/2008 Armstrong et al. ..... 381/312
2002/0118851 A1 8/2002 Paludan-Mueller
2005/0141736 A1 6/2005 Beimel et al.

FOREIGN PATENT DOCUMENTS

DE 102 45 567 B3 4/2004

(Continued)

OTHER PUBLICATIONS

Buchler, Michael Christoph, (2002). "Algorithms for Sound Classification in Hearing Instruments," Doctoral dissertation submitted to the Swiss Federal Institute of Technology Zurich. p. 114, para 3.

(Continued)

*Primary Examiner* — Curtis Kuntz
*Assistant Examiner* — Jasmine Pritchard
(74) *Attorney, Agent, or Firm* — Pearne & Gordon LLP

(57) ABSTRACT

A hearing device has an adjustable transfer function comprising M≧1 sub-functions (M is an integer). A method for operating the hearing device includes deriving input audio signals from a current acoustic environment. For each of the M sub-functions, derive, based on the input audio signals and for each class of N≧2 classes that describe a predetermined acoustic environment, a class similarity factor indicative of the similarity of the current acoustic environment with the predetermined acoustic environment described by the respective class (N is an integer). Derive from N predetermined base parameter sets assigned to the respective sub-function and in dependence of the class similarity factors, an activity parameter set for the respective sub-function. Each of the N base parameter sets assigned to the respective sub-function is assigned to a different class of the N classes. Adjust the respective sub-function by means of the activity parameter set.

19 Claims, 3 Drawing Sheets

FOREIGN PATENT DOCUMENTS

| | | | |
|---|---|---|---|
| EP | 0788290 | A1 | 8/1997 |
| EP | 1 118 248 | B1 | 7/2001 |
| EP | 1 203 508 | B1 | 5/2002 |
| EP | 1 219 138 | B1 | 7/2002 |
| EP | 1307072 | A2 | 5/2003 |
| EP | 1 359 787 | A2 | 11/2003 |
| EP | 1404152 | A2 | 3/2004 |
| EP | 1 432 282 | A2 | 6/2004 |
| EP | 1 538 874 | A2 | 6/2005 |
| WO | 99/65275 | A1 | 12/1999 |
| WO | 01/20965 | A3 | 3/2001 |
| WO | 01/22790 | A3 | 4/2001 |
| WO | 01/76321 | A1 | 10/2001 |
| WO | 02/32208 | A3 | 4/2002 |

OTHER PUBLICATIONS

European Search Report dated Mar. 29, 2007 in reference to European application No. EP06120253.7.

* cited by examiner

HEARING DEVICE WITH TRANSFER FUNCTION ADJUSTED ACCORDING TO PREDETERMINED ACOUSTIC ENVIRONMENTS

TECHNICAL FIELD

The invention relates to a method for operating a hearing device and to a hearing device. Under "hearing device", a device is understood, which is worn adjacent to or in an individual's ear with the object to improve the individual's acoustical perception. Such improvement may also be barring acoustical signals from being perceived in the sense of hearing protection for the individual. If the hearing device is tailored so as to improve the perception of a hearing impaired individual towards hearing perception of a "standard" individual, then we speak of a hearing-aid device. With respect to the application area, a hearing device may be applied behind the ear, in the ear, completely in the ear canal or may be implanted. A hearing system comprises at least one hearing device. Typically, a hearing system comprises, in addition, another device, which is operationally connected to said hearing device, e.g., another hearing device or a remote control.

BACKGROUND OF THE INVENTION

Modern hearing devices, in particular, hearing-aid devices, when employing different hearing programs (typically two to four; also referred to as audiophonic programs), permit their adaptation to varying acoustic environments, also referred to as acoustic scenes or acoustic situations. The idea is to optimize the effectiveness of the hearing device for the hearing device user in all situations.

The hearing program can be selected either via a remote control or by means of a selector switch on the hearing device itself. For many users, however, having to switch program settings is a nuisance, or it is difficult, or even impossible. It is also not always easy, even for experienced users of hearing devices, to determine, which program is suited best and offers optimum speech intellegibility at a certain point in time. An automatic recognition of the acoustic scene and a corresponding automatic switching of the program setting in the hearing device is therefore desirable.

The switch from one hearing program to another can also be considered a change in a transfer function of the hearing device, which transfer function describes how input audio signals generated by an input transducer unit of the hearing device relate to output audio signals to be fed to an output transducer unit of the hearing device.

There exist several different approaches to the automatic classification of acoustic environments (also referred to as acoustic surroundings). Typically, the methods concerned involve the extraction of different characteristics from an input signal. Based on the so-derived characteristics, a pattern-recognition unit employing a particular algorithm makes a determination as to the attribution of the analyzed signal to a specific acoustic environment.

As examples for classification methods and their application in hearing systems, the following publications shall be named: WO 01/20965 A2, WO 01/22790 A2 and WO 02/32208 A2.

Not in all acoustic environments, the program change based on the classification result provides for an optimum hearing sensation for the user. It is desirable to provide for an improved automatic adaptation of the transfer function of the hearing device to a current (actual) acoustic environment.

From U.S. Pat. No. 5,604,812, a hearing device is known, which, in absence of pre-stored hearing device settings, automatically and continuously adapts the transfer function by means of fuzzy logic. The results of such an approach may be unpredictable and might lead to undesired hearing device settings.

WO 99/65275 A1 discloses a device, e.g., a hearing device, with a signal processor, wherein parameters of the signal processor are directly steered in dependence of input signals.

SUMMARY OF THE INVENTION

One object of the invention is to create a hearing device and a method for operating a hearing device, which provide for an improved automatic adaptation of its transfer function to a current acoustic environment.

Another object of the invention is to provide for a flexibly adjustable way for automatically adapting the transfer function to a current acoustic environment.

Another object of the invention is to provide for a safe and robust way for automatically adapting the transfer function to a current acoustic environment.

Another object of the invention is to provide for a reliable and reproducible way for automatically adapting the transfer function to a current acoustic environment.

Another object of the invention is to avoid that a user of the hearing device is annoyed by sudden strong changes in the transfer function.

Another object of the invention is to avoid that a user of the hearing device is annoyed by repeated recognizable changes in the transfer function.

At least one of these objects is at least partially achieved by the methods and apparatuses according to the patent claims.

Further objects emerge from the description and embodiments below.

The method for operating a hearing device having an adjustable transfer function comprising M sub-functions, wherein M is an integer with $M \geqq 1$, and wherein said transfer function describes how input audio signals generated by an input transducer unit of said hearing device relate to output audio signals to be fed to an output transducer unit of said hearing device, comprises the steps of deriving said input audio signals from a current acoustic environment; and for each of said M sub-functions:

deriving, on the basis of said input audio signals and for each class of N classes each of which describes a predetermined acoustic environment, a class similarity factor indicative of the similarity of said current acoustic environment with the predetermined acoustic environment described by the respective class, wherein N is an integer with $N \geqq 2$;

deriving from N predetermined base parameter sets assigned to the respective sub-function and in dependence of said class similarity factors an activity parameter set for the respective sub-function, wherein each of said N base parameter sets assigned to the respective sub-function is assigned to a different class of said N classes;

adjusting the respective sub-function by means of said activity parameter set.

The method may be considered a method for adapting a transfer function of a hearing device to a current acoustic environment or to changes in an acoustic environment.

The hearing device comprises an input transducer unit for deriving input audio signals from a current acoustic environment;

an output transducer unit for receiving output audio signals;

a signal processing unit for deriving said output audio signals from said input audio signals by processing said input audio signals according to an adjustable transfer function, which adjustable transfer function describes how said input audio signals relate to said output audio signals and comprises M sub-functions, wherein M is an integer with $M \geqq 1$;

a classifier unit for deriving, on the basis of said input audio signals and for each class of N classes each of which describes a predetermined acoustic environment, a class similarity factor indicative of the similarity of said current acoustic environment with the predetermined acoustic environment described by the respective class, wherein N is an integer with $N \geqq 2$;

a base parameter storage unit storing, for each of said M sub-functions, N predetermined base parameter sets each assigned to a different class of said N classes;

a processing unit operationally connected to said base parameter storage unit and adapted to deriving an activity parameter set for each of said M sub-functions, wherein each of said activity parameter sets is derived in dependence of said class similarity factors from the base parameter sets assigned to the respective sub-function;

wherein each of said M sub-functions is adjusted by means of the respective activity parameter set.

Considered under a slightly different point of view, the hearing device according to the invention has a number of base parameter sets. These will usually be selected such that, applied to the transfer function (or, more particularly, each applied to the corresponding sub-function), they provide for an optimum hearing sensation in a predetermined acoustic environment. The base parameter sets may be found during a fitting procedure (also referred to as adaptation procedure or as training procedure), e.g., in a manner that is known from hearing-aid devices with a number of hearing programs between which one can switch. During the normal operation of the hearing device (which is different from a fitting or training phase), the current acoustic environment is analyzed, and a vector is derived, which contains information on the likenesses (similarities) of the current acoustic environment and each of the predetermined acoustic environments. Instead of only being able to simply choosing that one base parameter set belonging to the highest similarity value, the hearing device is capable of weighting the base parameter sets in dependence of their corresponding similarity value. This way, transfer function parameters can be adapted to changes of the acoustic situation in a continuous way. This adaptation is based on predetermined settings, which provides for robustness and reproducibility.

Considered under another slightly different point of view, a continuous mixture of hearing programs is achieved by mixing, in dependence of the current acoustic environment, parameters of the transfer function within the framework of predetermined base parameter settings. The invention takes into account that real-world acoustic environments seldomly correspond to pure sound classes like (pure) "music", (pure) "speech" or (pure) "speech in noise", but mostly have aspects of various classes. It takes also into account the existing knowledge of the fitter to define base parameter sets optimized for pure sound situations and builds upon this know-how.

The invention may be considered to provide for a "mixed-mode classification" or for a "mixed-program mode".

Within the present patent application, the processes involved in conjuntion with "classes", "classifying", "classification" and "classification" are certainly not meant to confine to solely assigning that one class to a current acoustic environment, which describes said current acoustic environment best; but it is meant to refer to any way of obtaining, for each of a multitude (2, 3, 4, 5 or more) of predetermined acoustic environments, a measure for the similarity (likeness, resemblance) of said current acoustic environment and the predetermined acoustic environment described by a respective class.

From a certain point of view, it is nevertheless possible to split up said step of deriving, on the basis of said input audio signals and for each class of N classes each of which describes a predetermined acoustic environment, a class similarity factor indicative of the similarity of said current acoustic environment with the predetermined acoustic environment described by the respective class, wherein N is an integer with $N \geqq 2$;

into the two steps of classifying, on the basis of said input audio signals, said current acoustic environment according to a set of N predetermined classes, which describe one predetermined acoustic environment each, wherein N is an integer with $N \geqq 2$; and outputting, for each of said N classes, a class similarity factor indicative of the similarity of said current acoustic environment with the predetermined acoustic environment described by the respective class.

Said similarity values can be obtained in a straight-forward manner from evaluating the differences between a classification result for the current acoustic environment and the classification result for each of said predetermined acoustic environments. E.g., euclidian distances or multivariate variance analysis can be used for obtaining such a difference.

The invention allows to prevent the occurrence of repeated strong changes in the transfer function, since it is possible to smoothly change transfer function parameters. On the other hand, the invention provides for reliable and predictable changes in the transfer function, since the framework of the base parameter sets avoids that parameters change in an undesired way or develop towards strange, inadequate settings. The latter might happen in solutions with an "automatic" adaptation of parameter sets based upon artificial cost functions, which do not fully reflect the full set of human audiological perception.

The invention is particularly useful also in hearing systems comprising two hearing devices (one dedicated to each ear of the user), in particular if the two hearing devices cannot communicate with each other, since differences in the transfer function changes between the two hearing devices—in particular if occurring in a step-wise manner—may be easily recognizable by the user and can be rather disturbing.

It can be considered an advantage of the invention, that the complex problem of automatically adapting the transfer function to a current environment is tackled basically by solving two main problems for which solutions are known: classification of a current acoustic environment, and optimally processing sound of predefined (pure) sound classes. Good ways for classifying acoustic environments are known, and good ways for deriving optimum base parameter sets for predefined sound classes are known. An activity parameter set can be obtained as an appropriate mixture of base parameter sets, wherein that mixture depends on the similarity values derived in conjunction with the classification.

It can be considered another advantage of the invention, that it can be made backward-compatible with known hard-switching one-program-at-a-time hearing devices, since it can easily be foreseen that, instead of using a mixture of base parameter sets, only the parameters of that one base parameter set are used, which is assigned to the class with the highest similarity value.

The transfer function may and usually will comprise two or more sub-functions, which shall undergo changes when the acoustic environment changes. I.e., the transfer function, through which usually many kinds of signal processing can be realized (including filtering, amplifying, compressing and many others), is subdivided into a number of meaningfully combined parts (the sub-functions), and at least some of the sub-functions can be controlled by an associated activity parameter set. Through a sub-function, e.g., beam forming, noise cancelling, feedback cancelling, dynamics processing or filtering, may be realized. An advantage of subdividing the transfer function into a number of sub-functions is, that specifying a sub-function and verifying that a sub-function is working correctly, is simpler than doing so with a very complex transfer function as a whole.

An activity parameter set may be several (two, three, four or more) parameters (values, numbers), but it may also be just one value or, in particular, one number, which could be considered a strength or an activity setting. Such a one-number strength may, e.g., range from "off" to "fully on" (or from 0 to 1 or from 0% to 100%) and indicate the degree to which the corresponding sub-function shall take effect or be in force. E.g., in the case of a beam-former sub-function, the activity setting could range from an omni-directional polar pattern to a maximally focussed directional characteristic typically towards the front (nose) of the hearing device user.

As will have become clear from the above, the activity parameter sets are obtained in dependence of the current acoustic environment. Accordingly, parameters of activity parameter sets are not predetermined and fixed. The value or values making up an activity parameter set are, during normal operation of the hearing device, frequently, typically quasi-continuously, re-calculated and updated. Therefore, the activity parameter sets are dynamic parameters sets. Accordingly, they can be considered sets of signals, referred to as activity signal sets.

In one embodiment, for each of said N classes, a class weight factor is derived from the corresponding class similarity factor, and, for each of said M sub-functions, said deriving of said activity parameter set comprises weighting each base parameter set assigned to the respective sub-function with the corresponding class weight factor.

Said deriving of said class weight factors may comprise, for at least one of said N classes, multiplication with an individual class factor and/or addition of an individual class offset.

In a second aspect of the invention besides the "mixed-mode classification" or "mixed-program mode" aspect, the invention may be seen in using a time-averaged activity parameter set for controlling at least one sub-function. This aspect can be of great value in conjunction with the above-described aspect of the invention ("mixed-mode classification" or "mixed-program mode" aspect), but it may be applied separately therefrom, in conjunction with any hearing device, which allows for gradual changes in the transfer function during normal operation, in particular when such changes in the transfer function are accomplished or requested automatically. Said activity parameter set may be just one parameter of the transfer function or a number of parameters of the transfer function.

This second aspect of the invention allows to provide for smooth changes in the transfer function, even if rather quick back-and-forth changes occur because of strongly changing acoustic environments.

In one embodiment, an averaging time for said time-averaging is chosen in dependence of past changes in the activity parameter set. I.e., the averaging time is chosen differently when the activity parameter set has changed a lot in the recent past with respect to when the activity parameter set has hardly changed in the recent past.

More particularly, the averaging time may be decreased, when said past changes in the activity parameter set decrease, and increased, when the said past changes in the activity parameter set increase. This kind of behavior can strongly decrease annoyingly fast changes in the transfer function when they are inadequate, while allowing for fast changes in the transfer function when they are necessary.

The advantages of the apparatuses correspond to the advantages of corresponding methods.

Further preferred embodiments and advantages emerge from the dependent claims and the figures.

BRIEF DESCRIPTION OF THE DRAWINGS

Below, the invention is described in more detail by means of examples and the included drawings. The figures show schematically.

The reference symbols used in the figures and their meaning are summarized in the list of reference symbols. Generally, alike or alike-functioning parts are given the same or similar reference symbols. The described embodiments are meant as examples and shall not confine the invention.

DETAILED DESCRIPTION OF THE INVENTION

Figure 1:
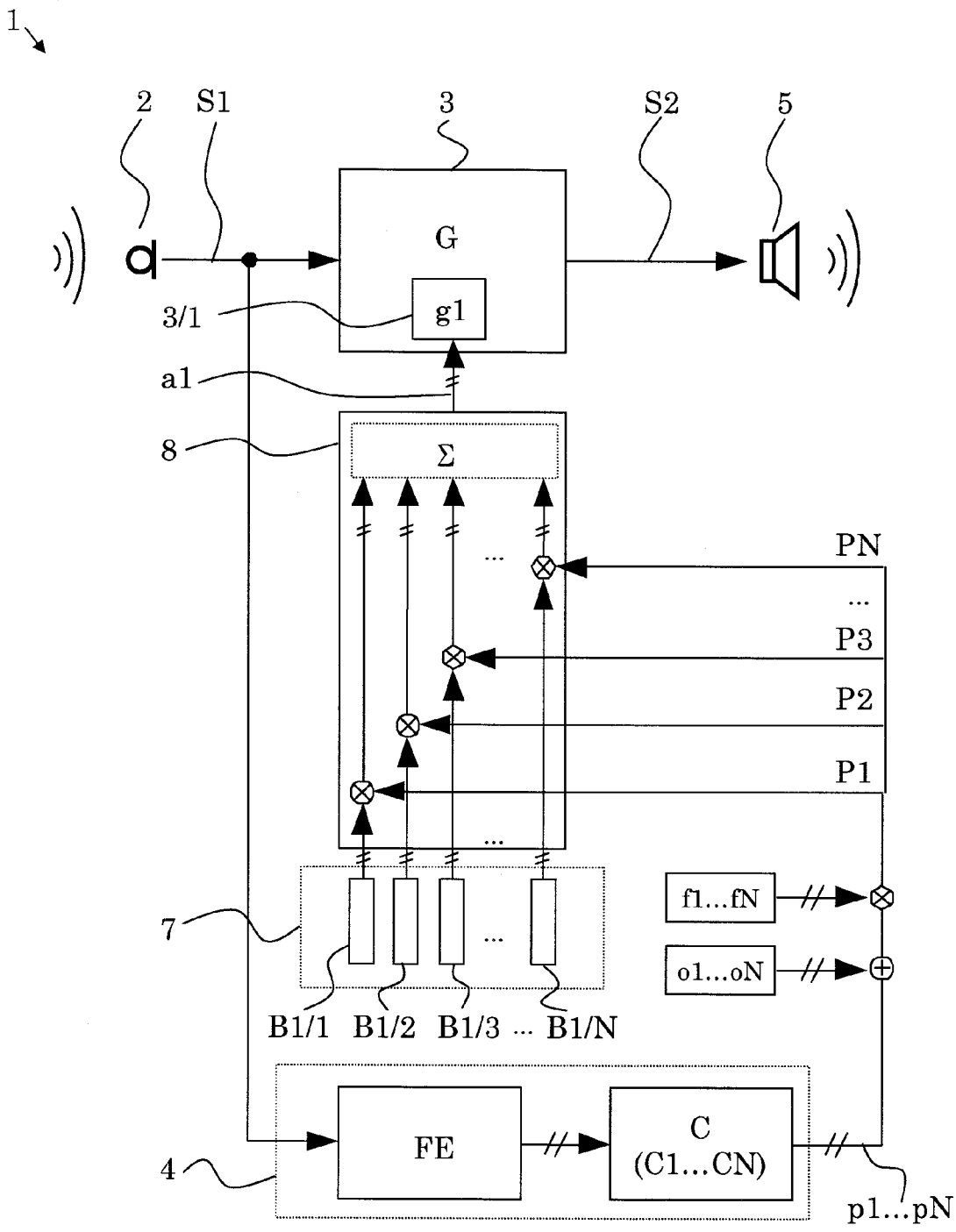
FIG. 1 a diagrammatical illustration of a hearing device.

FIG. 1 shows a diagrammatical illustration of a hearing device 1, which comprises an input transducer unit 2, e.g., a microphone or an arrangement of microphones, for transducing sound from the current (actual) acoustic environment into input audio signals S1, wherein audio signals are electrical signals, of analogue and/or digital type, which represent sound. The input audio signals S1 are fed to a signal processing unit 3 for processing according to a transfer function G, which can be adapted to the needs of a user of the hearing device in dependence of said current acoustic environment. The transfer function G is or comprises at least one sub-function. In FIG. 1, the transfer function G is or comprises only one sub-function g1, which is realized in a signal processing circuit 3/1. Said signal processing circuit 3/1 may, e.g., provide for beam forming or for noise suppression or for another part of the transfer function G.

From the input signals S1, the signal processing circuit 3 derives output audio signals S2, which are fed to an output transducer unit 5, e.g., a loudspeaker. The output transducer unit 5 transduces the output audio signals S2 into signals to be perceived by the user of the hearing device, e.g., into acoustic sound, as indicated in FIG. 1.

An automatic adaptation of the transfer function G to said current acoustic environment is accomplished in the following manner:

The input audio signals S1 are fed to a classifier unit 4, in which said current acoustic environment is classified, wherein any known classification method can in principle be used. I.e., the current acoustic environment, represented by the input audio signals S1, is compared to N predetermined acoustic environments, each described by one class of a set of N predefined classes C1 . . . CN.

A set of N class similarity factors p1 . . . pN is output, wherein each of the class similarity factors p1 . . . pN is indicative of the similarity of said current acoustic environment with the respective predetermined acoustic environment of classes C1 . . . CN or, put in other words, of the likeness (resemblance) of said current acoustic environment and the respective predetermined acoustic environment, or, expressed differently, of the degree of correspondence between said current acoustic environment and the respective predetermined acoustic environment.

The classification may be accomplished in various ways known in the art. E.g., as indicated in FIG. 1, the input audio signals S1 may be fed to a feature extractor FE, in which a set of (technical, auditory or other) features are extracted from the input audio signals S1. That set of features is analyzed and classified in a classifier C, which also provides for further processing in order to derive said class similarity factors p1 . . . pN.

Today, N may typically be N=2, N=3, N=4, N=5 or possibly larger. Typical classes may be "speech", "speech in noise", "noise", "music" or others. Typical features are, e.g., spectral shape, harmonic structure, coherent frequency and/or amplitude modulations, signal-to-noise ratio, spectral center of gravity, spatial distribution of sound sources and many more.

The automatic adaptation of the transfer function G is on the one hand based on said class similarity factors p1 . . . pN and on the other hand based on base parameter sets. Said base parameter sets are predetermined, and their respective values are usually obtained during a fitting procedure and/or may be at least partly pre-defined in the hearing device 1.

For each sub-function (in FIG. 1, there is only one sub-function g1 shown), one base parameter set B1/1, . . . , B1/N is provided per class, B1/1 for class C1, B1/2 for class C2, . . . and B1/N for class CN. I.e., for each class C1 . . . CN and each sub-function, there is one base parameter set. Each base parameter set comprises data (typically one number or several numbers), which optimally adjust the respective sub-function to the user's needs and preferences in the respective predefined acoustic environment.

In order to adapt the transfer function G, and in particular each sub-function, to a current acoustic environment, for each sub-function, the base parameter sets are mixed in dependence of their class similarity factors p1 . . . pN. In the embodiment of FIG. 1, this is accomplished by multiplying each base parameter set B1/1, . . . , B1/N with a respective class weight factor P1 . . . PN and summing up the accordingly weighted base parameter sets B1/1, . . . , B1/N in a processing unit 8. Said multiplication and summing up of base parameter sets is done separately for each parameter of a base parameter set.

Said class weight factors P1 . . . PN are derived from said class similarity factors p1 . . . pN. In the example of FIG. 1, the class weight factor P1 . . . PN are obtained by adding to each class similarity factor p1 . . . pN an individual class offset o1 . . . oN and multiplying the result (class-wise) by an individual class factor f1 . . . fN. An optional normalization of the class weight factors P1 . . . PN is not shown in FIG. 1. This enables an adaptation of the mixing and, accordingly, of the whole automatic adaptation behaviour, to preferences of the user.

The processing unit 8 outputs an activity parameter set a1 (generally: one for each sub-function), which is fed to the transfer function G, or, more precisely, to the respective sub-function. Accordingly, the transfer function G is adapted to the current acoustic environment in a fashion based on the predetermined base parameter sets.

A simple example:

M=1, g1: beamformer; N=2, C1: music, C2: speech in noise. The according base parameter sets B1/1, B1/2 do not have to be derived in a fitting procedure, but can be preprogrammed by the hearing device manufacturer: B1/1=0, B1/2=1, which means that no beam forming (zero activity of g1) shall be used when the user wants to listen to music, and full beam forming (full activity of g1) shall be used when the user wants to understand a speaker in a noisy place. Zero beam forming activity will usually mean that an omnidirectional polar pattern of the input transducer unit 2 shall be used, and full beam forming activity will typically mean that a high sensitivity towards the front direction (along the user's nose) shall be used, with little sensitivity for sound from other directions.

When the user is in an acoustic environment with p1=99% and p2=1%, i.e., the classification result implies that the current acoustic environment is practically pure music, the beam former (realized by sub-function g1) is run with (at least approximately) B1/1, i.e., at practically zero activity (o1=o2=0, f1=f2=1 implied).

When the user is in an acoustic environment with p1=1% and p2=99%, i.e., the classification result implies that the current acoustic environment is practically purely speech-in-noise, the beam former (realized by sub-function g1) is run with (at least approximately) B1/2, i.e., with practically full activity (o1=o2=0, f1=f2=1 implied).

When, however, the user is in an acoustic environment with p1=40% and p2=60% (e.g., in a restaurant situation with background music), i.e., the classification result implies that the current acoustic environment has aspects of music and somewhat stronger aspects of speech-in-noise, the beam former (realized by sub-function g1) is run with 0.4×B1/1+0.6×B1/2, i.e., with moderate activity (o1=o2=0, f1=f2=1 implied). The beam former may provide for a medium emphasis of sound from the front hemisphere and only little suppression of sound from elsewhere.

Of course, instead of the simple linear behaviour of the mixing of the base parameter sets that is exemplary discussed above, also more sophisticated (non-linear) ways of mixing the base parameter sets may be applied.

If it is particularly important to the user to understand speech in noisy surroundings, whereas he is not particularly fond of music, this individual preference may be taken into account by using something like o1=0, o2=0.3 and/or f1=0.8, f2=1.5, or the like.

Another simple example:

M=1, g1: gain model (amplification characteristic); N=2, C1: music, C2: speech. The according base parameter sets B1/1, B1/2 will usually be derived in a fitting procedure and indicate the amplification in dependence of incoming signal power that shall be used; characterized, e.g., in terms of decibel values characterizing the incoming signal power and compression values characterizing the steepness of increase of output signal with increase of incoming signal power. E.g., B1/1=(50 dB, 2.5; 90 dB, 0.8; 110 dB, 0.3; 0) indicating expansion below 50 dB, light compression up to 90 dB, strong compression up to 110 dB and limiting (infinite compression) thereabove. On the other hand, for speech, other values may be used, e.g., B1/1=(30 dB, 2.5; 80 dB, 0.4; 105 dB, 0.2; 0) indicating expansion below 30 dB, medium compression up to 80 dB, strong compression up to 105 dB and limiting thereabove. These rather arbitrarily chosen numbers for the base parameter sets shall just indicate one possible way of forming base parameter sets. Usually, gain models are furthermore frequency-dependent, so that the base parameter sets will, in addition, comprise frequency values and, accordingly, even more decibel values and compression values (for the various frequency ranges).

When the user is in an acoustic environment with p1=99% and p2=1%, i.e., the classification result implies that the current acoustic environment is practically pure music, the gain model (realized by sub-function g1) is run with (at least approximately) B1/1 (o1=o2=0, f1=f2=1 implied).

When the user is in an acoustic environment with p1=1% and p2=99%, i.e., the classification result implies that the current acoustic environment is practically pure speech, the gain model (g1) is run with (at least approximately) B1/2 (o1=o2=0, f1=f2=1 implied).

When, however, the user is in an acoustic environment with p1=40% and p2=60% (e.g., in a conversation situation with background music), i.e., the classification result implies that the current acoustic environment has aspects of music and somewhat stronger aspects of speech, the beam former (g1) is run with 0.4×B1/1+0.6×B1/2 (o1=o2=0, f1=f2=1 implied). I.e., the gain model is a linear combination of the gain model for music and the gain model for speech, obtained in processing unit 8. The activity parameter set a1 may be identical with this linear combination. Such an activity parameter set a1 is, of course, no more just a simple strength value or an activity setting. Such an activity parameter set a1 can already be, without further processing, the parameters used in the corresponding sub-function.

Of course, instead of the simple linear behaviour of the mixing of the base parameter sets that is exemplary discussed above, also more sophisticated (non-linear) ways of mixing the base parameter sets may be applied.

Said class similarity factors p1, p2 can be obtained, e.g., in the following manner (in classifier unit 4):

In the feature extractor FE, a number of features is extracted from the input audio signals S1, e.g., rather technical characteristics like the signal power between 200 Hz and 600 Hz relative to the overall signal power and the harmonicity of the signal, or auditory-based characteristics like common build-up and decay processes and coherent amplitude modulations. Each examined feature provides for at least one value in a feature vector. For one specific current acoustic environment (represented by the input audio signals S1), the feature vector might be (3.0; 2.6; 4.1); note that usually, there will typically be between 5 and 10 or even more features and vector components. There is one feature vector for each predetermined acoustic environment, e.g., (5.3; 1.8; 3.6) for class C1 and (1.2; 3.1; 3.9) for class C2. The class similarity factors p1, p2 are a measure for the inverse distance between the feature vector of the current acoustic environment and the feature vector of class C1 and class C2, respectively. I.e., p1, p2 are measures for the closeness of the feature vector of the current acoustic environment and the feature vector of class C1 and class C2, respectively. A measure for said distance can be obtained, e.g., as the euclidian distance between the vectors, or by means of multivariate variance analysis. For example, the inverse of the square root of the sum of the squares of the differences between the components of the vectors can be used, i.e., $$\begin{aligned} p1 &= 1/sqrt\{(3.0-5.3)\wedge 2+(2.6-1.8)\wedge 2+(4.1-3.6)\wedge 2\} \\ &= 1/sqrt(6.18) \\ &= 0.402 \text{ and} \end{aligned}$$

$$\begin{aligned} p2 &= 1/sqrt\{(3.0-1.2)\wedge 2+(2.6-3.1)\wedge 2+(4.1-3.9)\wedge 2\} \\ &= 1/sqrt(3.53) \\ &= 0.532. \end{aligned}$$

In this case, the current acoustic environment is more similar to class C2 than to class C1, since p1<p2.

Of course, normalization of each feature vector component (corresponding to a specific feature), e.g., to a range from 0 to 1, and/or a normalization during determining p1,p2 is advisable, and it is also possible to weight different features differently strong during determining p1,p2. A suitable normalization allows to generate class similarity factors, which lie between 0 and 1 and can therefore be expressed in percent (%), wherein the likeness of the current acoustic environment with a predetermined acoustic environment is the higher, the higher (and closer to 100%) the corresponding class similarity factor is. The p1, p2 values in the two simple examples above were assumed to be class similarity factors normalized in such a way.

Figure 2:
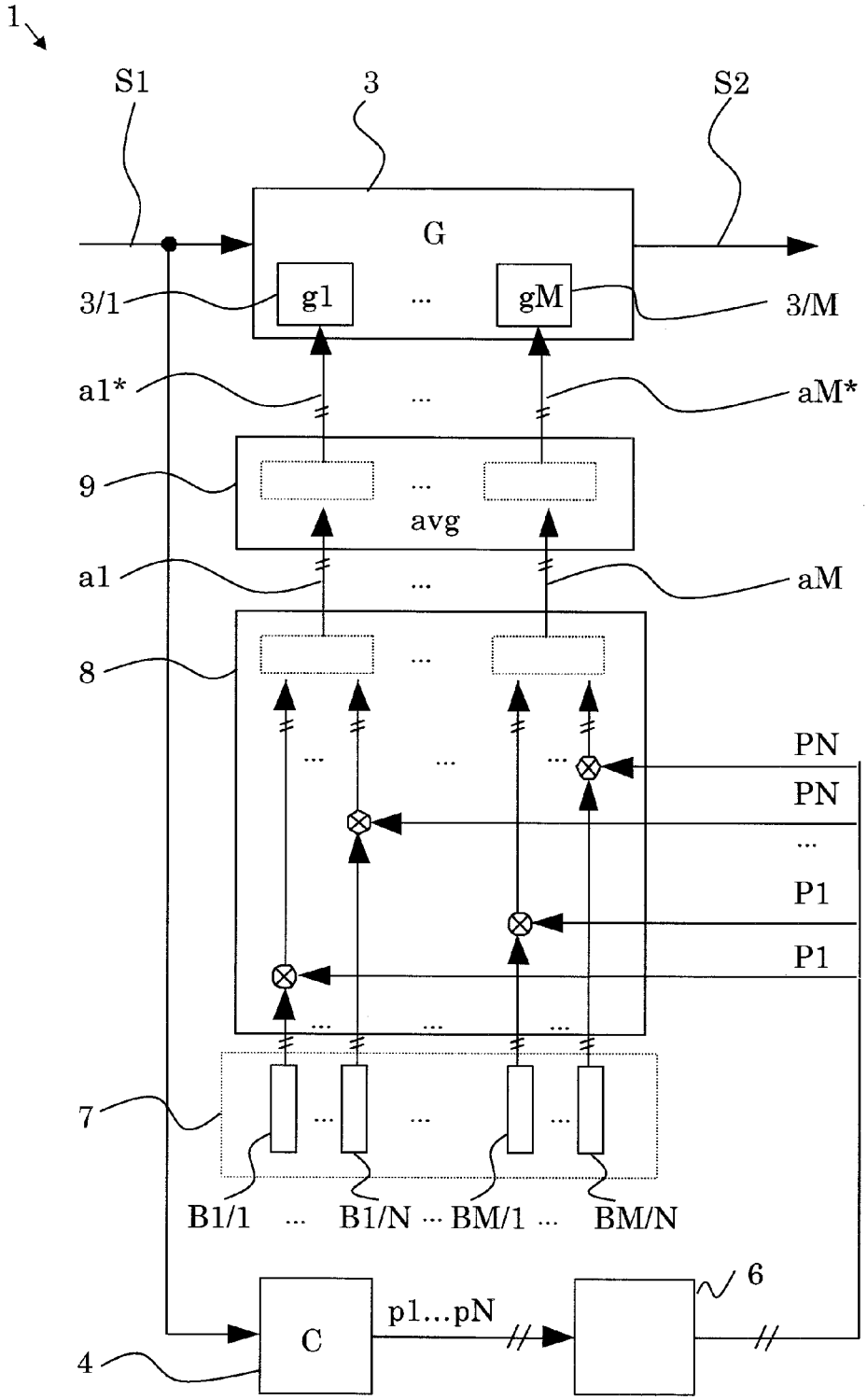
FIG. 2 a diagrammatical illustration of a hearing device.

FIG. 2 shows a diagrammatical illustration of a hearing device 1, which is similar to the hearing device 1 of FIG. 1; the underlying principle is basically the same as in FIG. 1. But the hearing device 1 comprises an averaging unit 9, and at least two sub-functions g1 . . . gM are drawn. And, the class similarity factors are processed by a processing circuit 6, which outputs the class weight factors P1 . . . PN. The processing circuit 6 may perform various calculations, in particular take care of individual adaptations as provided by f1 . . . fN and o1 . . . oN (see FIG. 1).

The averaging unit 9 outputs time-averaged activity parameter sets a1* . . . aM*, which are used for steering the sub-functions g1 . . . gM. The advantages of this will become clear in the following.

The above-described mixing of base-parameter sets already provides for a significant improvement over prior art hearing devices, which can only run at one of a number of predetermined hearing programs at a time, wherein these hearing programs correspond to base parameter sets, which are optimized for a corresponding predefined class. The according switching between the predetermined hearing programs in such prior art hearing devices can be annoying to the user, in particular, if similarity values for competing classes are about equal to each other (e.g., about 50% for each of two classes). In that case, a frequent switching between hearing programs may occur. Since, by means of the above-described mixing of base-parameter sets, (quasi-) continuous adaptations of the transfer function G are possible by means of the invention (without switching), and smooth and agreeable changes will take place in most situations.

There are, nevertheless, situations, when there might still occur undesirable recognizable changes in the transfer function G despite of the base parameter set mixing. E.g., in a car, classification may change within seconds from nearly 100% speech (conversation at a red light) to nearly 100% noise (acceleration) to nearly 100% music (car radio) to nearly 100% speech-in-noise (car radio speaker at medium or high speeds). A too fast adaptation of the transfer function may, in such a case, be undesirable.

A preferable behaviour of the adaptation of the transfer function G shall, as far as possible, fulfill the following points:

1. Upon a changing acoustic situation, the hearing device shall change its signal processing sufficiently fast, but as inconspicuous to the user as possible. This should provide for an optimum performance during most of the time.

2. In a constantly strongly changing situation, however, the user shall not be annoyed by the partly significant changes in signal processing, which would be needed for a full adaptation to different acoustic environments.

These features can be accomplished, at least in part, by means of the following behaviour:

a. In a constantly strongly changing situation, the partly significant changes in signal processing, which would be needed for a full adaptation to different sound classes, shall be averaged out, in order to achieve a more constant (more stable) signal processing.

b. When (after strong changes) an acoustic situation is (again) practically stable (for a certain span of time), the signal processing shall slowly fade towards the appropriate parameter set values (activity parameter sets) for this situation.

c. Only, when class similarity factors have remained relatively stable for a sufficiently long time (i.e., detection of a rather constant acoustic situation for a certain span of time), the hearing device shall (again) react fast upon a detected significant change in the acoustic environment.

Figure 3:
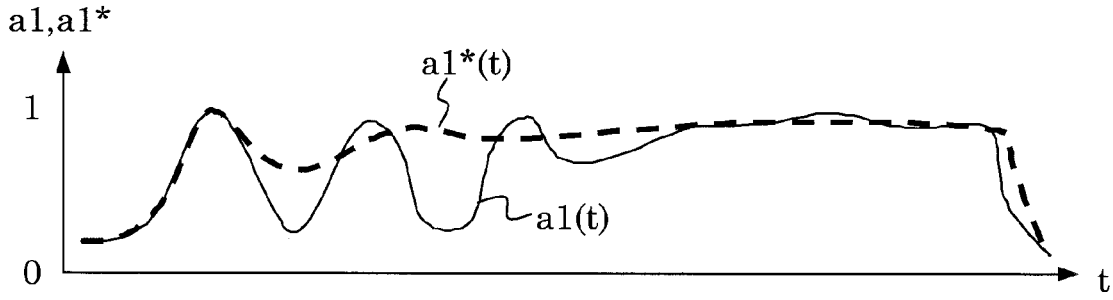
FIG. 3 an illustration of an activity parameter and a corresponding time-averaged activity parameter as a function of time.

FIG. 3 is a schematic illustration of an activity parameter a1 and a corresponding time-averaged activity parameter a1* as a function of time t, which shall illustrate the above-depicted behaviour, wherein—for reasons of simplicity—only one parameter of an activity parameter set, or an activity parameter set comprising only one parameter is assumed. When fast great changes happen to a1, a1* will not fully follow a1. Later then, when changes in a1 become weaker, a1* slowly drifts towards a1. Finally, after quite a while of approximately constant conditions, a rapid strong change in a1 will be followed by a1* rather quickly and in full.

Figure 4:
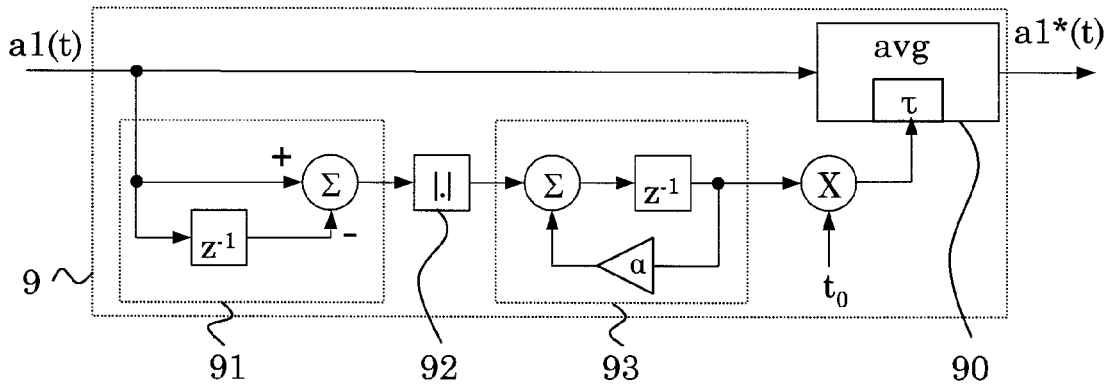
FIG. 4 an exemplary embodiment of an averaging unit.

Such a behaviour can be readily implemented in form of software or otherwise. One exemplary implementation is shown in FIG. 4. The averaging unit 9 receives a1($t$) and outputs a1*($t$). The averaging time $\tau$, during which a1($t$)-values are averaged, is controlled in dependence of past a1($t$)-values.

a1($t$) is fed to a differentiator 91, which outputs a value representative of the derivative of a1($t$), i.e., a measure for the changes in a1($t$). Therefrom, the absolute value is taken (reference 92), which then is integrated (summed up) in a leaky integrator 93. Through a leakage factor $\alpha$, the time, until which the circuit reacts again to a fast change of the input after a series of former fast input changes, is determined.

Accordingly, a measure for the magnitude of changes during the past time is obtained. The corresponding value can be multiplied with a base time constant $t_0$ for adjustment. The so-obtained value is used as the time constant $\tau$ for an averager 90, which averages a1($t$) during a time span $\tau$ and outputs the so-derived a1*($t$).

Using an averager with different attack and release time constants (not shown) allows the averaging unit to settle towards a predetermined percentage of the dynamic range of the many fast changes, when many fast changes occur. Only when the input to the averaging unit settles, the output of the averaging unit will follow slowly.

Both, the averaging in the averaging unit 9 and the processing in the processing unit 8 may be adjusted individually for different parameters of an activity parameter set and/or for parameter sets for different sub-functions. E.g., for sub-functions, which tend to strongly annoy the user when subject to rapid changes, greater time constants for averaging may be chosen (e.g., via $t_0$), whereas a more rapid following of a1*($t$) to a1($t$) may be chosen for sub-functions that result in less strong irritations when changed. In the case of an averager with different attack and release time constants (not shown), different ratios of attack time constants to release time constants may be chosen for different sub-functions.

As has already been stated above, it is possible to have just one single parameter as a1 for a sub-function. That parameter can be considered the "strength" or the "activity" of the sub-function.

It is to be noted that a time-averaging like the time-averaging described above, may not only be used for activity parameters (or more particularly, for each value or number of an activity parameter set), but may also be used, in general, for smoothing any other adjustments of a transfer function G. It is applicable to any (dynamically and/or continuously) adjustable processing algorithm.

It is furthermore to be noted, that the various units and parts in the Figures are merely logic units. They may be implemented in various ways, e.g., all in one processor chip or distributed over a number of processors; in one or several pieces of software and so on.

List of Reference Symbols

| | |
|---|---|
| 1 | hearing device |
| 2 | input transducer unit, microphone unit, microphone |
| 3 | signal processing unit, transmission unit |
| 3/1 . . . 3/M | signal processing circuits |
| 4 | classifier unit |
| 5 | output transducer unit, loudspeaker |
| 6 | processing circuit |
| 7 | base parameter storage unit |
| 8 | processing unit |
| 9 | averaging unit |
| 90 | differentiator |
| 91 | averager |
| 92 | calculating the absolute value |
| 93 | integrator |
| a1 . . . aM | activity parameter set |
| a1* . . . aM* | time-averaged activity parameter set |
| B1/1 . . . BM/N | base parameter sets |
| C | classifier |
| C1 . . . CN | classes |
| FE | feature extractor |
| f1 . . . fN | individual class factor |
| G | transfer function |
| g1 . . . gM | sub-function |
| M | number of sub-functions |
| N | number of classes |
| o1 . . . oN | individual class offset |
| p1 . . . pN | class similarity factor |
| P1 . . . PN | class weight factor |
| S1 | input audio signals |
| S2 | output audio signals |
| t | time |
| $t_0$ | base time constant |
| $\alpha$ | leakage factor |
| $\tau$ | time constant for averaging, averaging time |

The invention claimed is:

1. A method for operating a hearing device having an adjustable transfer function comprising M sub-functions, wherein M is an integer with $M \geqq 1$, and wherein said transfer function describes how input audio signals generated by an input transducer unit of said hearing device relate to output audio signals to be fed to an output transducer unit of said hearing device, said method comprising the steps of deriving said input audio signals from a current acoustic environment; and for each of said M sub-functions:

deriving, on the basis of said input audio signals and for each class of N classes each of which describes a predetermined acoustic environment, a class similarity factor indicative of the similarity of said current acoustic environment with the predetermined acoustic environment described by the respective class, wherein N is an integer with N≧2;

deriving from N predetermined base parameter sets assigned to the respective sub-function and in dependence of said class similarity factors an activity parameter set for the respective sub-function, wherein each of said N base parameter sets assigned to the respective sub-function is assigned to a different class of said N classes;

adjusting the respective sub-function by means of said activity parameter set.

2. The method for operating the hearing device according to claim 1, with M≧2.

3. The method for operating the hearing device according to claim 1, wherein the base parameter sets are chosen such that using each of the M base parameter sets assigned to one specific class of said N classes for adjusting the sub-function to which the respective base parameter set is assigned provides for optimized output audio signals, when said current acoustic environment is identical with the predetermined acoustic environment described by that specific class.

4. The method for operating the hearing device according to claim 1, wherein each of said activity parameter sets comprises a multitude of values, in particular a multitude of numbers.

5. The method for operating the hearing device according to claim 1, wherein each of said activity parameter sets is a single value, in particular, a single number.

6. The method for operating the hearing device according to claim 1, comprising the step of deriving, for each of said N classes, a class weight factor from the corresponding class similarity factor;

wherein, for each of said M sub-functions, said deriving of said activity parameter set comprises weighting each base parameter set assigned to the respective sub-function with the corresponding class weight factor.

7. The method for operating the hearing device according to claim 6, wherein, for at least one of said N classes, said deriving of said class weight factor comprises multiplication with an individual class factor and/or addition of an individual class offset.

8. The method for operating the hearing device according to claim 1, wherein, for at least one of said M sub-functions, a time-averaged activity parameter set is used for adjusting the respective at least one of said M sub-functions.

9. The method for operating the hearing device according to claim 8, further comprising the step of choosing an averaging time for said time-averaging in dependence of past changes in the respective activity parameter set.

10. The method for operating the hearing device according to claim 9, further comprising the steps of decreasing said averaging time when said past changes in the respective activity parameter set decrease; and increasing said averaging time when said past changes in the respective activity parameter set increase.

11. The method for operating the hearing device according to claim 1, wherein at least one of the group comprising beam forming, noise cancelling, feedback cancelling, dynamics processing, filtering is realized by means of at least one of said M sub-functions.

12. A hearing device comprising an input transducer unit for deriving input audio signals from a current acoustic environment;

an output transducer unit for receiving output audio signals;

a signal processing unit for deriving said output audio signals from said input audio signals by processing said input audio signals according to an adjustable transfer function, which adjustable transfer function describes how said input audio signals relate to said output audio signals and comprises M sub-functions, wherein M is an integer with M≧1;

a classifier unit for deriving, on the basis of said input audio signals and for each class of N classes each of which describes a predetermined acoustic environment, a class similarity factor indicative of the similarity of said current acoustic environment with the predetermined acoustic environment described by the respective class, wherein N is an integer with N≧2;

a base parameter storage unit storing, for each of said M sub-functions, N predetermined base parameter sets each assigned to a different class of said N classes;

a processing unit operationally connected to said base parameter storage unit and adapted to deriving an activity parameter set for each of said M sub-functions, wherein each of said activity parameter sets is derived in dependence of said class similarity factors from the base parameter sets assigned to the respective sub-function;

wherein each of said M sub-functions is adjusted by means of the respective activity parameter set.

13. The hearing device according to claim 12, with M≧2.

14. The hearing device according to claim 12, wherein, for each of said N classes, the M base parameter sets assigned to one specific class of said N classes are chosen such that optimized output audio signals are generated when said M base parameter sets are each used for adjusting that sub-function to which the respective base parameter set is assigned and when said current acoustic environment is identical with the predetermined acoustic environment described by said specific class.

15. The hearing device according to claim 12, wherein each of said activity parameter sets comprises a multitude of values, in particular a multitude of numbers.

16. The hearing device according to claim 12, wherein each of said activity parameter sets is a single value, in particular, a single number.

17. The hearing device according to claim 12, wherein said processing unit comprises an averaging unit for deriving, for each of at least one of said M sub-functions, a time-averaged activity parameter set, and wherein said at least one of said M sub-functions is adjusted by means of the respective time-averaged activity parameter set.

18. A hearing device comprising means for deriving input audio signals from a current acoustic environment;

means for processing said input audio signals according to an adjustable transfer function, which transfer function comprises M sub-functions, wherein M is an integer with M≧1;

means for deriving, on the basis of said input audio signals and for each class of N classes each of which describes a predetermined acoustic environment, a class similarity factor indicative of the similarity of said current acoustic environment with the predetermined acoustic environment described by the respective class, wherein N is an integer with N≧2;

means for deriving an activity parameter set for each of said M sub-functions, wherein each of said activity parameter sets is derived in dependence of said class similarity factors from N base parameter sets assigned to the respective sub-function, wherein each of said N base parameter sets assigned to the respective sub-function is assigned to a different class of said N classes;

wherein each of said M sub-functions is adjusted by means of the respective activity parameter set.

19. A hearing system comprising the hearing device according to one of claims 12 to 18 and, in addition, another device, which is operationally connectable to said hearing device.

* * * * *